US005573024A

United States Patent [19]

DeVaney et al.

[11] Patent Number: 5,573,024

[45] Date of Patent: Nov. 12, 1996

[54] GUTTER WASHER

[76] Inventors: Danny L. DeVaney, 2925-57th St. S.E., Auburn, Wash. 98092; William DeVaney, 20522-13th Dr. S.E., Bothell, Wash. 98012

[21] Appl. No.: 572,728

[22] Filed: Dec. 14, 1995

[51] Int. Cl.[6] ..... B08B 3/02

[52] U.S. Cl. ..... 134/167 R; 134/167 C; 134/201; 134/172; 15/92

[58] Field of Search ..... 134/166 R, 167 R, 134/166 C, 167 C, 115, 201, 172; 52/16; 15/92

[56] References Cited

U.S. PATENT DOCUMENTS 3,751,749 8/1973 Wilson .
4,238,866 12/1980 Taylor .
4,349,039 9/1982 Egger .
4,718,613 1/1988 Moomaw .
4,958,397 9/1990 Ryan .
5,022,586 6/1992 Putnam .

*Primary Examiner*—Frankie L. Stinson
*Attorney, Agent, or Firm*—David L. Tingey

[57] ABSTRACT

A gutter washer comprising a wheel-shaped guide disposed rotatably on a cylindrical section of a nozzle is adapted to run on a roof gutter rim. The guide comprises a guide rim projecting radially from one end of a guide hub member, which rotates on the nozzle cylindrical section, and a plurality of lugs jutting radially from an opposite end of the hub member. Thus, the hub member becomes a circumferential track with the guide lugs running inside and the guide rim running outside of the gutter rim. When a gutter spike is encountered, the guide lugs step over it while keeping at least 2 lugs below the rim which is tangent to the circumferential track. A rigid tube is attached to the nozzle near the guide rim at a first tube end; the second tube end is adapted for connection of a garden water hose.

22 Claims, 4 Drawing Sheets

GUTTER WASHER

BACKGROUND

1. Field of the Invention

This invention relates generally to gutter washers and, more particularly, to gutter washers that are guided by a gutter rim as the washer is moved along the gutter in the manner of spray washing.

2. Description of the Prior Art

Accumulation of leaves and debris in rain water gutters commonly attached to roofs causing obstructions and clogging in the gutters is a well known problem. Climbing on the roof or a ladder to clean the gutters is troublesome and possibly unsafe. Therefore, a number of remote gutters washers have been disclosed that extend a garden hose to the gutter through a hollow but rigid tube with a spray nozzle on its end to wash debris from a gutter with garden hose water pressure. However, difficultly is generally encountered in keeping the nozzle properly directed in the gutter, therefore devices have been disclosed that use the gutter rim as a track to guide the nozzle along the gutter. For example, Lawson in U.S. Pat. No. 4,978,241 describes a supporting roller rolling on a two sides of a gutter rim with a larger stabilizing roller therebetween intended to run within the gutter. Putnam in U.S. Pat. No. 5,022,586 describes a hub member rolling on a gutter rim and guided thereon by a wheel member attached thereto intended to run on the inside of the gutter.

Gutters are usually mounted to a roof with large spikes extending from outside the gutter through the gutter rim across the gutter near its top, through a gutter inside rim and into the roof. Thus, when guide devices such as described by Lawson and Putnam run along the gutter, they encounter the large spikes across the gutter. The gutter washer must then be lifted over the spikes and repositioned on the gutter rim. This is awkward, time-consuming and troublesome.

The object of the present invention is to provide an improved gutter washer adapted to be guided by a gutter rim as it rolls on it but able to step over gutter spikes without removing the washer from the gutter.

SUMMARY OF THE INVENTION

The object of the invention is achieved in a wheel-shaped guide comprising a guide rim projecting radially from one end of a guide hub member and a plurality of lugs jutting radially from an opposite end of the hub member. In use then, the hub member becomes a circumferential track riding on a gutter rim with the guide lugs running inside and the guide rim running outside of the gutter rim. When a gutter spike is encountered, the guide lugs step over it while keeping at least 2 lugs below the rim which is tangent to the circumferential track.

The guide hub is disposed rotatably on a cylindrical section of a nozzle. A nozzle head having a nozzle spray hole is located near the guide lugs for directing water into a gutter when the guide circumferential track is on the gutter rim. A rigid tube is attached to the nozzle near the guide rim at a first tube end; the second tube end is adapted for connection of a garden water hose.

To assure that at least 2 lugs are below the gutter rim as the guide rides on it, the lugs are equally spaced apart angularly on the hub member and extend from the hub member a distance, D, defined by $$D=R(1-\cos A)/\cos A$$

where R is the radius of the circular guide hub member and A is the angle at which the lugs are spaced apart. Typically, there are 8 lugs equally spaced apart by an angle of 45 degrees, in which case D is the radius, R, multiplied by 0.414. If the hub member has a 1¾-inch radius, then the lug must extend greater than about ¾ inch. In the preferred embodiment, the lugs actually extend radially from the hub approximately 1⅛ inch for extending into a gutter in use to inhibit exiting off the gutter rim.

DETAILED DESCRIPTION OF THE PREFERRED EMBODIMENT

Figure 1:
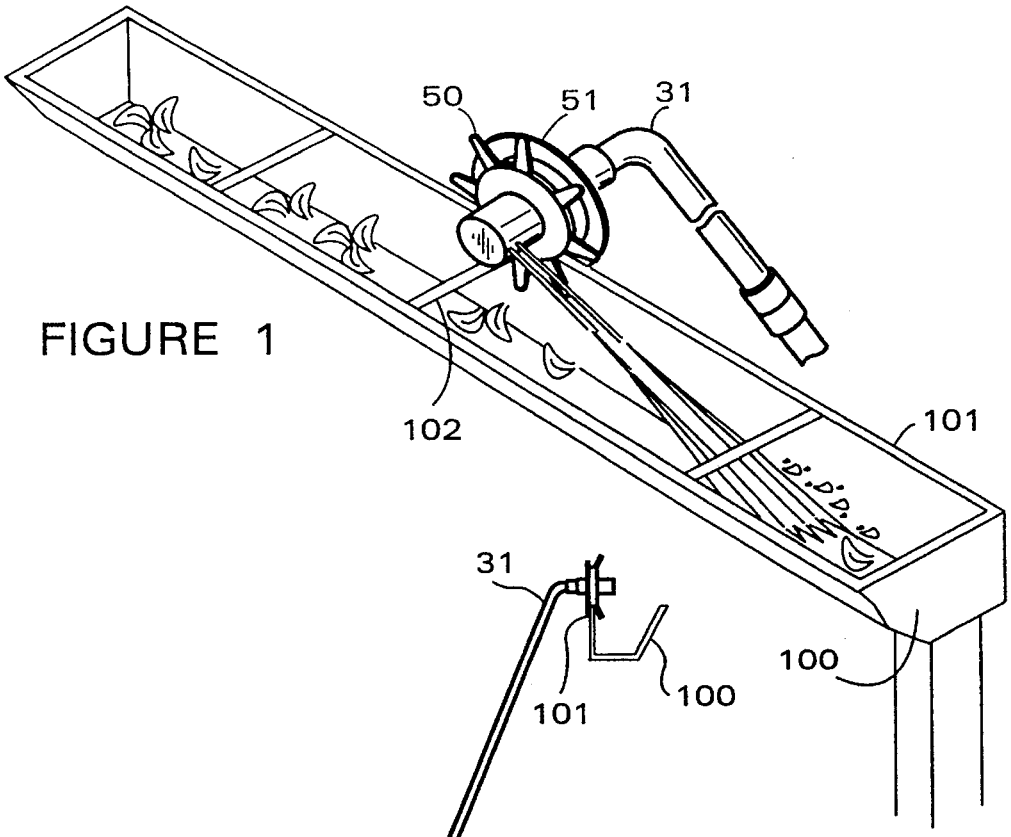
FIG. 1 is a pictorial view of the gutter washer in use on a typical gutter.
Figure 2:
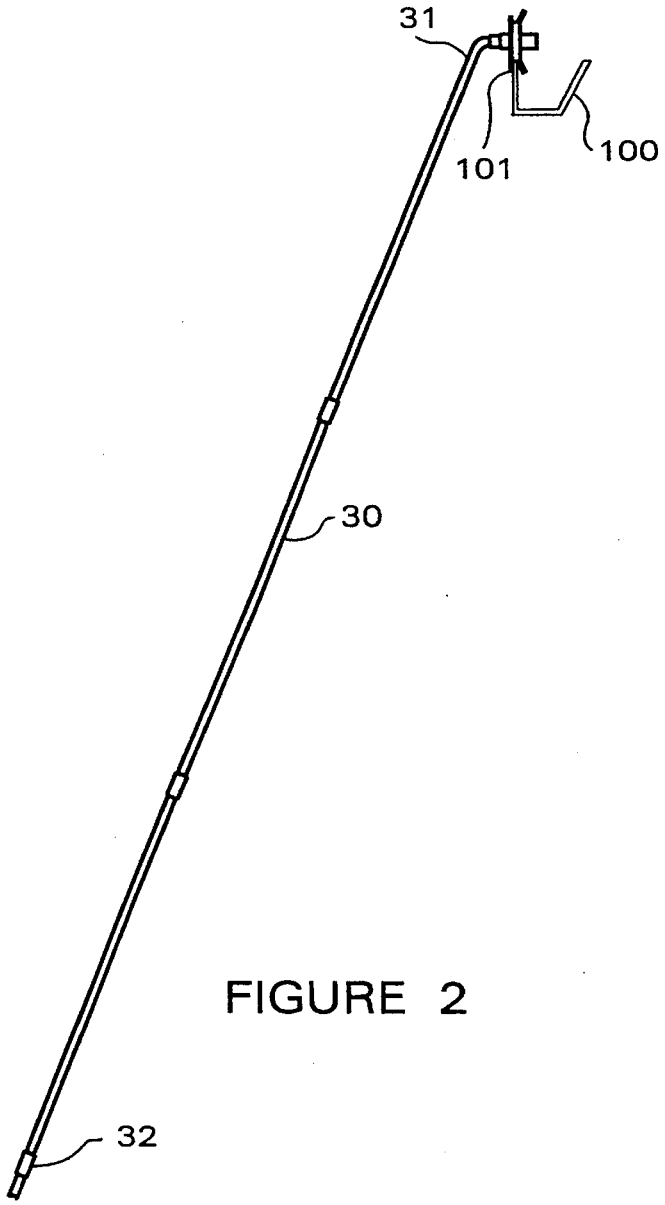
FIG. 2 is a pictorial side view of the gutter washer extended on multiple-segmented inflexible tube to a typical gutter.
Figure 3:
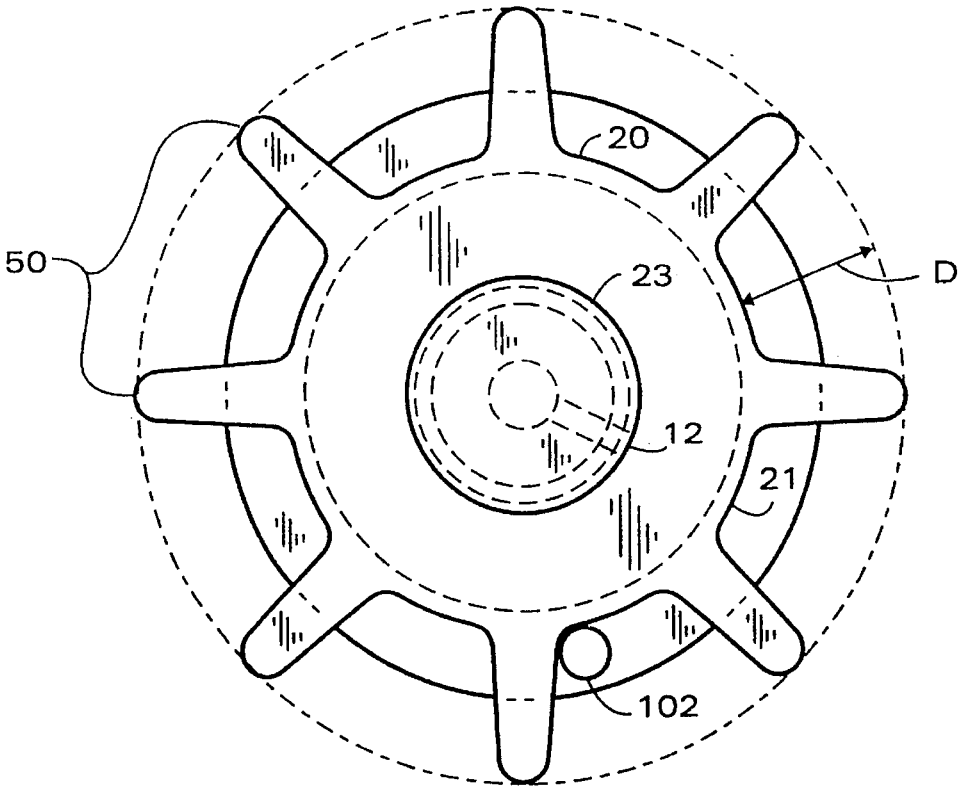
FIG. 3 is an end view of the guide lugs stepping over a gutter support spike as the washer rolls on the gutter rim.
Figure 4:
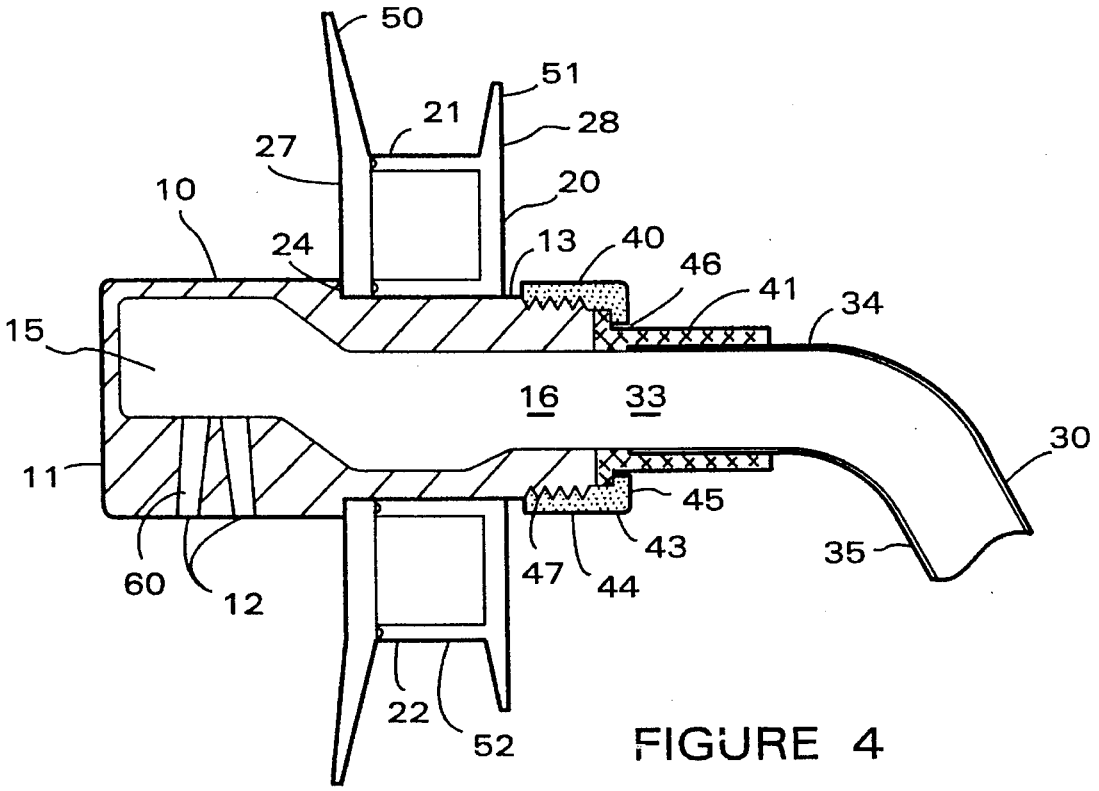
FIG. 4 is a cross-section view of the gutter washer
Figure 5:
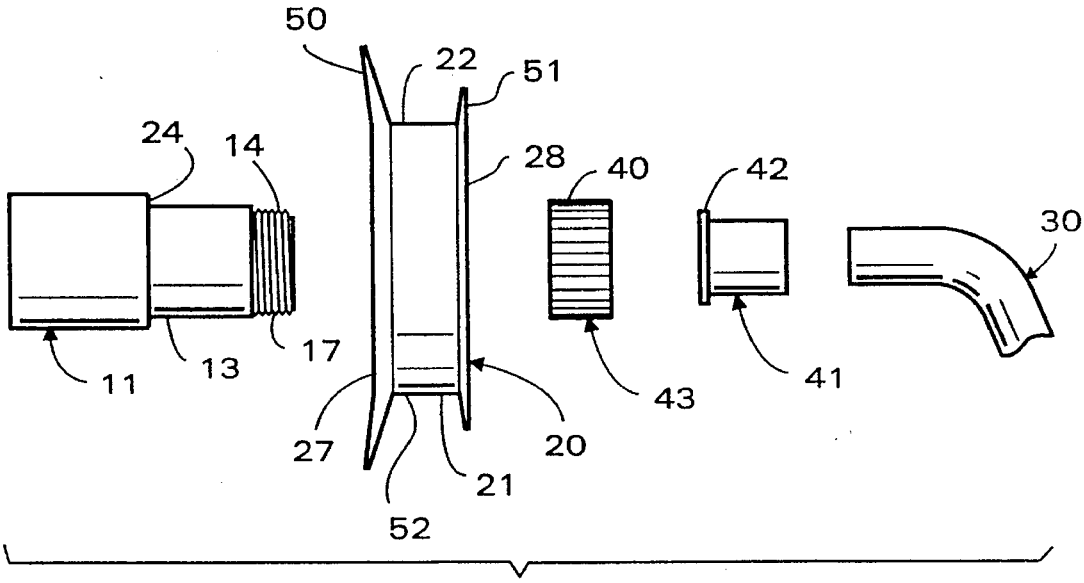
FIG. 5 is an exploded side view of the invention.
Figure 6:
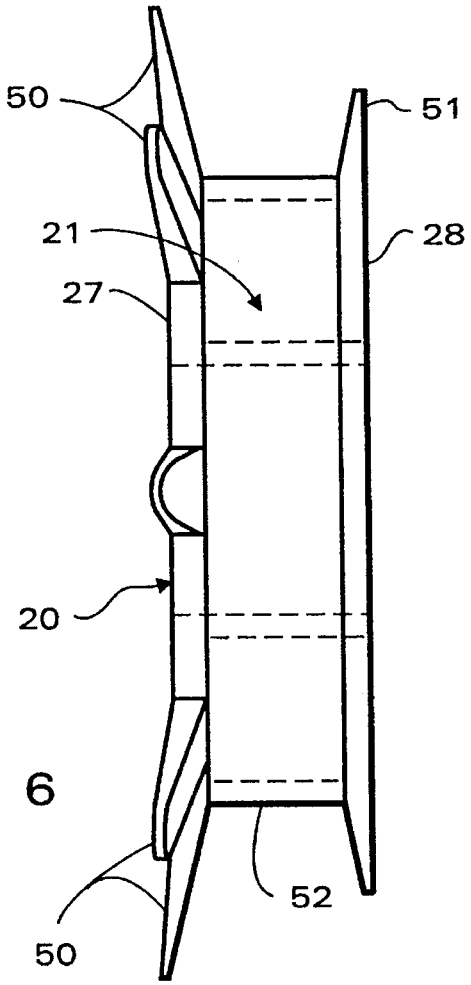
FIG. 6 is a side view of the wheeled guide.
Figure 7:
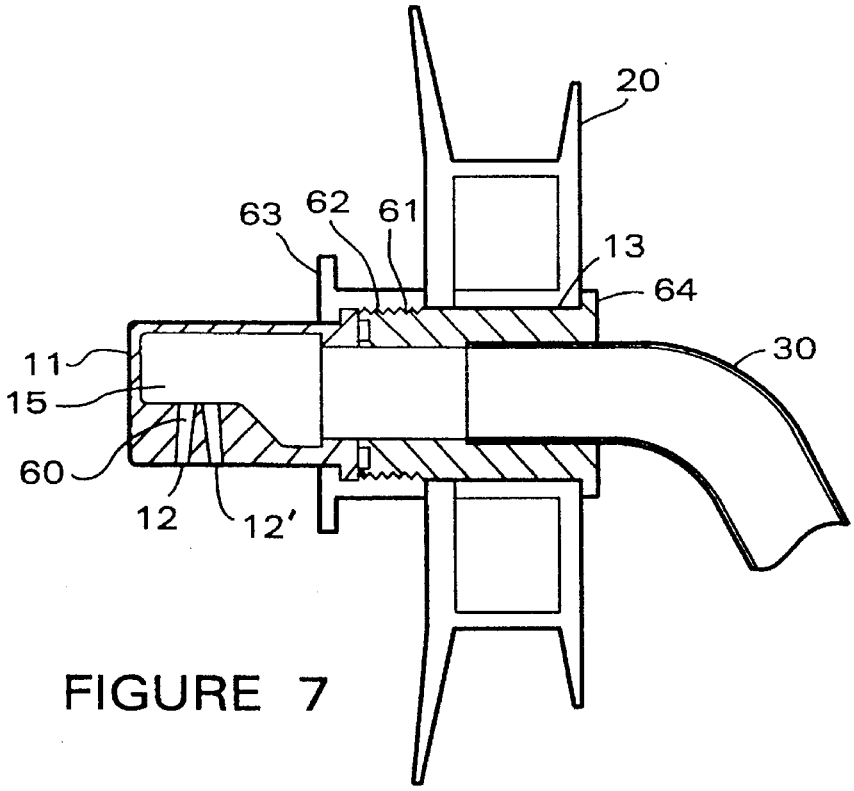
FIG. 7 is a side view of an alternative embodiment comprising a nozzle head detachable from the nozzle cylindrical section on which the wheel member is mounted.
Figure 8:
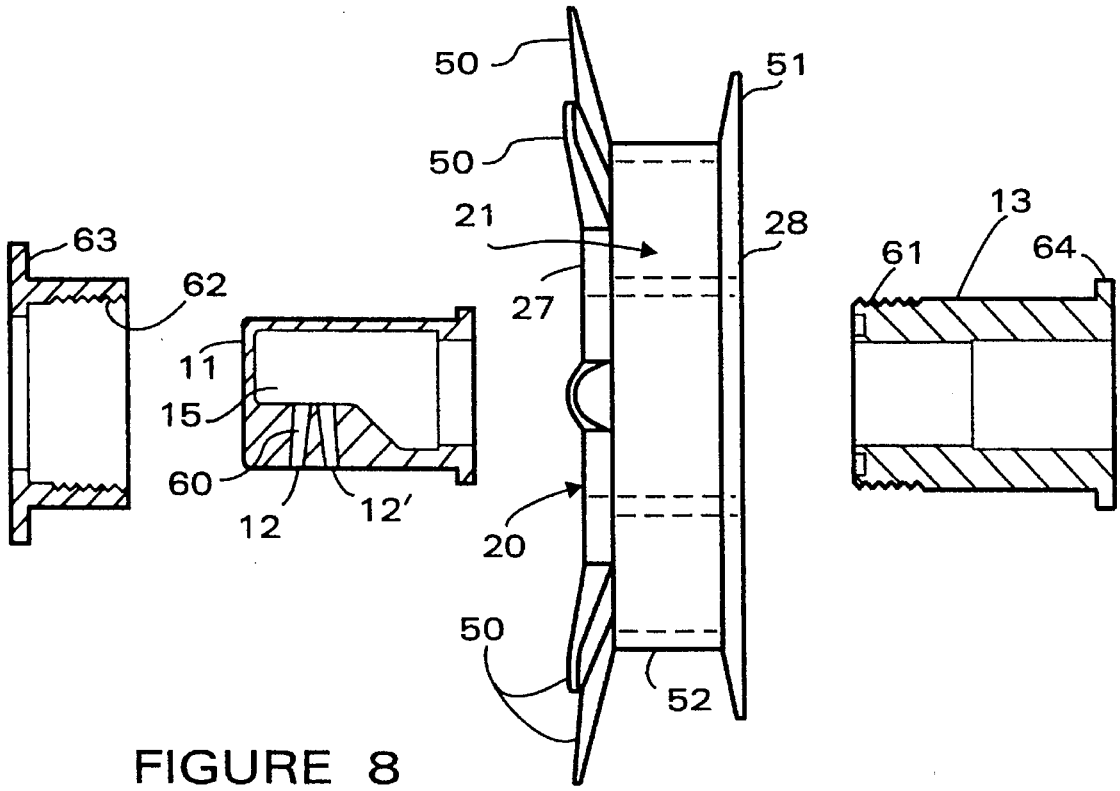
FIG. 8 is an exploded side view of the alternative embodiment.

Referring to the drawings, the gutter washer of the present invention adapted to roll on a rim 101 of a roof gutter 100 and step over gutter spikes 102 comprises nozzle 10, a wheel member 20 disposed rotatably on the nozzle 10, and an elongate inflexible tube 30 connected to the nozzle 10 at an orifice 33 at a tube first end 31 and adapted to be connected to a garden hose at a tube second end 32.

The inflexible tube 30 typically comprises a first section 34 connected to the nozzle 10 normal to the wheel member 20 and a second section 35 oblique to the first section 34 in fluid communication therewith forming an extension handle that allows a user standing on the ground to operate the washer with the wheel member 20 rolling on a roof gutter rim 101, so as to avoid entanglements with adjacent hedges, flower beds and the like.

The nozzle 10 includes a head 11 with one or more spray holes 12 adjustably directed approximately parallel to the wheel member 20 and a cylindrical section 13 extending from the head 11 and terminating in a free end 14. A water source (not shown) is attached to the gutter washer nozzle 10 in fluid communication with the spray hole 12 through a nozzle chamber 15 having an orifice 16 in the nozzle 10 where the elongate tube 30, which is connected to a water source, is attached. Typically, the chamber 15 passes through the nozzle cylindrical section 13 to which the tube 30 is attached into the nozzle head 11.

The wheel member 20 is preferably mounted on the nozzle cylindrical section 13 proximate the nozzle head 11 such that the wheel member circumferential track may be positioned on a gutter rim 101. The wheel member 20 includes a cylindrical hub member 21 having a circumference 22 and with a concentric hole 23 through which the nozzle cylindrical section 13 passes axially providing a wheel member axis of rotation. The wheel member 20 is restrained to the nozzle cylindrical section on its head side by a ledge 24 at the nozzle head and on its other side by a stop 40 on the nozzle cylindrical section 13 both the ledge and the stop being larger than the wheel member hole 23, preventing the wheel member 20 from passing.

The stop 40 comprises a grip 41 on the tube 30 having a radial lip 42, a retainer 43 over the grip 41 having sides 44 and a base 45 with a hole 46 in the base through which the tube 30 passes but sized such that the grip lip 41 does not pass therethrough, the retainer sides 44 sized to fit over the grip lip 42 and extends to the nozzle cylindrical section free end 14 to which it is attached with the grip lip 42 secured between the retainer base 45 and the nozzle cylindrical section free end 14.

To enable the nozzle 10 to be rotationally adjustable to that the nozzle spray hole 12 can be directed in a selective direction, the nozzle cylindrical section free end 14 is provided with external threads 17, and the retainer 43 is rotatably secured to the tube 30 with internal threads 47 matching the external threads 17. The nozzle cylindrical section free end 14 is then adjusted by rotating the nozzle head 11 to a selective position relative to the tube 30 before tightening the retainer 43 to the free end 14 on the matching threads.

A plurality of angularly equally-spaced apart lugs 50 project radially from the hub member 21 on a hub first end 27. A continuous guide 51 also projects radially from the hub member 21 on a hub second end 28 forming a circumferential track 52 on the hub member 21 between the lugs 50 and the guide 51. To prevent the washer wheel member 20 from falling off the gutter rim 101, the lugs 50 project from the hub member 21 a distance, D, approximately 1 inch, but at least greater than $$R\times(1-\text{cosine } A)/(\text{cosine } A).$$

where the hub member 21 has a radius, R, and the lugs 50 are spaced apart by the angle, A, Thus, at all times that the circumferential track 52 is on the gutter rim 101, at least 2 lugs 50 extend below the tangentially positioned gutter rim 101 to guide the wheel member 20 and keep it on the gutter rim 101. Typically, the wheel member 20 is provided with 8 lugs spaced apart by 45 degrees.

The nozzle spray hole 12 characteristically comprises a channel 60 of extended length tapered with slightly decreasing cross-section from the nozzle chamber 15. With such a taper, water is focussed as it is directed from the chamber 15 to discharge countering typical divergence of water as it leaves a hole to better provide a water cleaning force to a gutter.

The spray hole 12 can comprise a plurality of holes 12' which diverge relative to each other from the nozzle chamber. The spray hole or holes 12 in the nozzle head 11 are spaced apart from the wheel member lugs 50 such that when mounted on a gutter rim 101, the spray hole 12 is directed at the gutter 100 near its center 102. Typically, the holes 12' are in the nozzle head with the wheel member 20 mounted on the nozzle cylindrical section 13 with the lugs 50 and nozzle head 11 inside the gutter rim 101 and the guide 51 and tube 30 outside the gutter rim 101.

An alternative embodiment comprises a nozzle head 11 detachably mounted on the nozzle cylindrical section 13 so that heads may be exchanged or replaced. Typically, external threads 61 are provided on the nozzle cylindrical section 13 that match internal threads 62 in the head 11. The head 11 is maintained in place by a retaining nut 63 also on the cylindrical section threads 61 and tightened against the head 11. The retaining nut 63 also keeps the wheel section from passing off of the cylindrical section 11. In this embodiment, the wheel member 20 may be mounted from the head side of the cylindrical section 13, in which case the cylindrical section stop 40 may comprise a ledge 64 opposite the wheel member 20 from the nozzle head 11 larger than the hub member hole 23. The cylindrical section 13 may be affixed to the inflexible tube 30 or be removably connected, such as by threading them together on matching threads.

One skilled in the art will recognize the advantages taught by this invention and illustrated by the preferred embodiment presented. The specification and drawings are not intended to represent an exhaustive description of the invention. Obvious applications and extensions of the invention are intended to be within the spirit and scope of this invention.

Having described the invention, what I claim is:

1. A gutter washer for attachment to a water source such as a garden hose, the gutter washer adapted to roll on a rim of a roof gutter and step over gutter support spikes typically attaching a gutter to a roof to passing transversely through the gutter into the roof, the improvement comprising a circular wheel member including a hub member with a concentric hole therethrough and a circumference, a plurality of lugs projecting radially from the wheel hub member, a guide also projecting radially from the hub member and spaced apart from the plurality of lugs forming a circumferential track therebetween, a water nozzle including a head with a spray hole and a cylindrical section extending from the head and terminating in a free end, the cylindrical section passing axially through the wheel member hole providing a wheel member axis of rotation, means for restraining the wheel member to the nozzle cylindrical section, means for attaching a water source to the water nozzle in fluid communication with the spray hole.

2. The gutter washer of claim 1 in which the nozzle spray hole is directed approximately parallel to the wheel member.

3. The gutter washer of claim 2 further comprising means for rotationally adjusting the nozzle to direct the nozzle spray hole at a selective direction approximately parallel to the wheel.

4. The gutter washer of claim 3 in which means for rotationally adjusting the nozzle to direct the nozzle spray hole at a selective direction comprises a nozzle cylindrical section free end with external threads and a retainer rotatably secured to the water source with internal threads matching the external threads with the nozzle cylindrical section free end nozzle attached adjustably in rotation by rotating the nozzle to a selective position relative to the tube before tightening the retainer to the free end on the matching threads.

5. The gutter washer of claim 1 comprising lugs projecting radially from the hub member a distance such that with the hub member rolling on the gutter rim the lugs prevent the hub member from falling off said rim.

6. The gutter washer of claim 5 comprising lugs projecting radially from the hub member a distance of approximately 1 inch.

7. The gutter washer of claim 1 further comprising an inflexible tube between the hose stop and the water source.

8. The gutter washer of claim 7 in which the inflexible tube comprises a first section coaxial with the nozzle and a second section oblique to the first section and in fluid communication therewith and adapted to connection with a water source.

9. The gutter washer of claim 1 wherein the means for restraining the wheel member to the nozzle cylindrical section comprises a ledge on the first nozzle cylindrical section end larger than the hub member hole.

10. The gutter washer of claim 1 wherein the means for restraining the wheel member to the nozzle cylindrical section comprises a stop larger than the hub member hole to prevent the wheel member from passing past the stop and located on the nozzle cylindrical section free end with the wheel member between the stop and the nozzle head, means for attaching the stop to the nozzle cylindrical section free end.

11. The gutter washer of claim 10 in which the means for attaching the stop to the nozzle cylindrical section free end comprises a grip on the tube having a radial lip, a retainer over the grip having sides and a base with a hole in the base through which the tube passes but sized such that the grip lip does not pass therethrough, the retainer sides sized to fit over the grip lip extending to the nozzle cylindrical section free end to which it is attached with the grip lip secured between the retainer base and the nozzle cylindrical section free end.

12. The gutter washer of claim 11 in which the stop comprises the retainer attached to the nozzle cylindrical section free end.

13. The gutter washer of claim 1 in which the means for attaching a water source to the water nozzle in fluid communication with the spray hole comprises a nozzle cylindrical section and head with a nozzle chamber having an orifice in the nozzle cylindrical section where the water source is attached providing fluid communication between the water source and the nozzle spray hole.

14. The gutter washer of claim 13 further comprising a nozzle with a spray hole having a channel of extended length tapered with decreasing cross-section from the nozzle chamber.

15. The gutter washer of claim 14 further comprising a plurality of spray holes each having a channel of extended length tapered with decreasing cross-section from the nozzle chamber.

16. The gutter washer of claim 15 in which two or more of the spray holes channels are diverging relative to each other from the nozzle chamber.

17. The gutter washer of claim 1 in which the wheel member is mounted on the nozzle cylindrical section proximate the nozzle head such that the wheel member circumferential track may be positioned on a gutter rim with the lugs and nozzle head inside the gutter rim and the guide and water source outside the gutter rim.

18. The gutter washer of claim 17 in which the spray hole in the nozzle head is spaced apart from the wheel member lugs such that when mounted on a rim of a gutter, the spray hole is directed at the gutter.

19. The gutter washer of claim 1 further comprising a circular wheel member with a radius, R, a plurality of lugs angularly spaced apart by an angle, A, and projecting radially from the hub member a distance, D, such that at all times the wheel member circumferential track is on the gutter rim tangential to the wheel member circumferential track, at least 2 lugs extend below the tangentially positioned gutter rim to guide the wheel member and keep it on the gutter rim, where the distance, D, is greater than R (1–cosine A)/cosine A.

20. The gutter washer of claim 19 further comprising 8 lugs spaced equally apart by an angle equal to 45 degrees and extending radially from the hub member a distance, D, equal to the wheel member radius R multiplied by 0.414, where (1–cosine A)/cosine A=0.414.

21. The gutter washer of claim 1 further comprising a detachably mounted nozzle head with a threaded hole, a cylindrical section with threads matching those of the nozzle head, means for retaining the nozzle head threaded onto the cylindrical section at a selective position and a selective rotational orientation.

22. The gutter washer of claim 21 in which the means for restraining the wheel member to the nozzle cylindrical section comprises the nozzle head and a ledge on the cylindrical section opposite the wheel member from the nozzle head, both larger than the hub member hole.

* * * * *